US006758352B2

(12) United States Patent
Gervasi

(10) Patent No.: US 6,758,352 B2
(45) Date of Patent: Jul. 6, 2004

(54) COLLAPSIBLE DISPLAY STRUCTURE AND SHELF MODULE FOR USE THEREWITH

(75) Inventor: Paul Gervasi, Ste-Anne-de-Bellevue (CA)

(73) Assignee: 90034174 Quebec Inc., Ste-Anne-de-Bellevue (CA)

( * ) Notice: Subject to any disclaimer, the term of this patent is extended or adjusted under 35 U.S.C. 154(b) by 2 days.

(21) Appl. No.: 10/029,395

(22) Filed: Dec. 28, 2001

(65) Prior Publication Data

US 2003/0121872 A1 Jul. 3, 2003

(51) Int. Cl.[7] ..... A47F 5/00

(52) U.S. Cl. ..... 211/149; 211/135; 211/187; 108/134

(58) Field of Search ..... 211/149, 135, 211/187, 153, 90.02, 90.04, 90.01; 108/134

(56) References Cited

U.S. PATENT DOCUMENTS 3,362,610 A * 1/1968 Van Dyke
3,807,622 A * 4/1974 Belcher et al. ..... 211/149 X
3,827,573 A * 8/1974 Guerette ..... 211/149
4,236,460 A * 12/1980 Poupko
4,519,319 A * 5/1985 Howlett
4,570,805 A 2/1986 Smith
4,664,040 A * 5/1987 Levenberg ..... 211/187 X
5,257,701 A * 11/1993 Edelson ..... 211/149
5,443,168 A 8/1995 Dyment et al.
5,628,523 A 5/1997 Smith
5,826,732 A 10/1998 Ragsdale

* cited by examiner

*Primary Examiner*—Robert W. Gibson, Jr.

(57) ABSTRACT

A collapsible display structure and a shelf module for insertion therein are provided. The display structure includes a back panel and a first and second wing panel that are connected to the back panel and are movable between an expanded position and a collapsed position. The interior surface of the wing panels includes guides for receiving a shelf module. The shelf modules include a frame and a merchandise-receiving portion for holding an item of merchandise to be displayed. The shelf modules further include guide-engaging elements for engaging the guides on the display structure. The shelf module includes a locking device that is movable between a locked position and an unlocked position. In the locked position the locking device prevents the shelf module from being removed from the display structure. In the unlocked position the locking device allows the shelf module to be removed from the display structure.

34 Claims, 9 Drawing Sheets

COLLAPSIBLE DISPLAY STRUCTURE AND SHELF MODULE FOR USE THEREWITH

FIELD OF THE INVENTION

The present invention relates to the field of display structures suitable for displaying merchandise. More specifically, the present invention relates to collapsible display structures capable of receiving shelf modules for holding merchandise.

BACKGROUND OF THE INVENTION

Display structures for displaying articles of merchandise are well known in the art. Such display structures are commonly used in retail outlets such as grocery stores and pharmacies for displaying small articles of merchandise such as cosmetics and toiletries.

Merchandise display structures, according to the prior art, generally include a back panel and two side panels that are rigidly connected to one another. These rigidly connected panels create a cumbersome structure that is difficult to transport and occupies a large amount of storage space when not in use. In addition, merchandise display structures according to the prior art often include holes or grooves in their back panels through which merchandise-receiving portions such as hooks or shelves are connected. This essentially means that the merchandise-receiving portions are cantilevered from the back panel. When the merchandise is placed on these merchandise-receiving portions, a significant amount of force is exerted on the connection between the merchandise-receiving portion and the back panel. This force can cause damage to the back panel and, in a worse case scenario, can even cause the connection between the back panel and merchandise-receiving portion to break entirely.

Traditionally, display structures are made of either a thick cardboard or a combination of plastics and metal. A deficiency associated with cardboard display structures is that they are not particularly strong, nor are they particularly resistant. For example, if a cardboard display structure is exposed to water or humidity during transportation or storage, the cardboard weakens enough to essentially render the display structure useless. As for the display structures that are made of a combination of plastics and metal, the interaction of moving metal parts against plastic parts can cause excessive wear on the plastic parts, which ultimately shortens the life span of the display structure.

Therefore, there exists a need in the industry for a merchandise display structure that solves at least in part some of the disadvantages set forth above.

SUMMARY OF THE INVENTION

In accordance with a broad aspect, the present invention provides a collapsible display structure that comprises a back panel having a front surface, a back surface, and two opposed lateral eddies. The collapsible display structure further comprises a first wing panel and a second wing panel each having an interior surface including guides for receiving at least a portion of a shelf module, an exterior surface and a peripheral edge. The first wing panel and the second wing panel are hingedly connected to the back panel such that the first wing panel and the second wing panel care movable between an expanded position and a collapsible position. In the expanded position the interior surface of the first wing panel and the interior surface of the second wing panel face each other and are positioned to receive therebetween a shelf module for engagement with the guides on the interior surfaces of the first wing panel and the second wing panel.

An advantage of the collapsible display structure described above is that the first wing panel and the second wing panel are movable between a collapsed position and an expanded position. This makes the display structure easy to transport and easy to store since it occupies less space when in the collapsed position. The collapsible display structure described above further has the advantage of guides located on the interior surfaces of the first and second wing panels that are able to support both lateral sides of shelf modules inserted within the display structure.

In accordance with a second broad aspect, the present invention provides a shelf module suitable for use with a collapsible display structure including guides for engaging the shelf module. The shelf module comprises a frame having a front portion, a brick portion and two opposed side portions. The shelf module comprises a merchandise-receiving portion that is suitable for holding an item of merchandise to be displayed and is positioned between the front portion and the back portion and between the two opposed side portions. The shelf module further comprises guide-engaging elements positioned along the two opposed side portions for engaging the guides of the display stand, and a locking device comprising an elongated strip having two terminal ends with a first blocking element positioned on one terminal end and a second blocking element positioned on the other terminal end. The locking device is movable between a locked position and an unlocked position, wherein in the locked position the two blocking elements extend past the guide-engaging elements, and in the unlocked position the two blocking elements are located inwardly of the guide-engaging elements.

In a specific example of implementation the merchandise-receiving portion includes a platform suitable for holding merchandise to be displayed. In a variant, the merchandise-receiving portion includes a hooks for holding the merchandise to be displayed. In a still further variant, the shelf module includes at least one universal connector for receiving different types of merchandise-receiving portions.

An advantage of the shelf module described above is that it includes guide-engaging elements that enable it to slidably engage guides on a display structure. This configuration supports both lateral sides of the shelf module which therefore more uniformly supports the load of the merchandise placed on the shelf module than a shelf module that is cantilevered from a black panel. A further advantage of the above-described shelf module is that it includes a locking device that prevents the shelf module from involuntarily being removed from a display structure or from accidentally falling out of a display structure.

BRIEF DESCRIPTION OF THE DRAWINGS

A detailed description of examples of implementation of the present invention is provided herein below with reference to the following drawings, in which.

Figure 1:
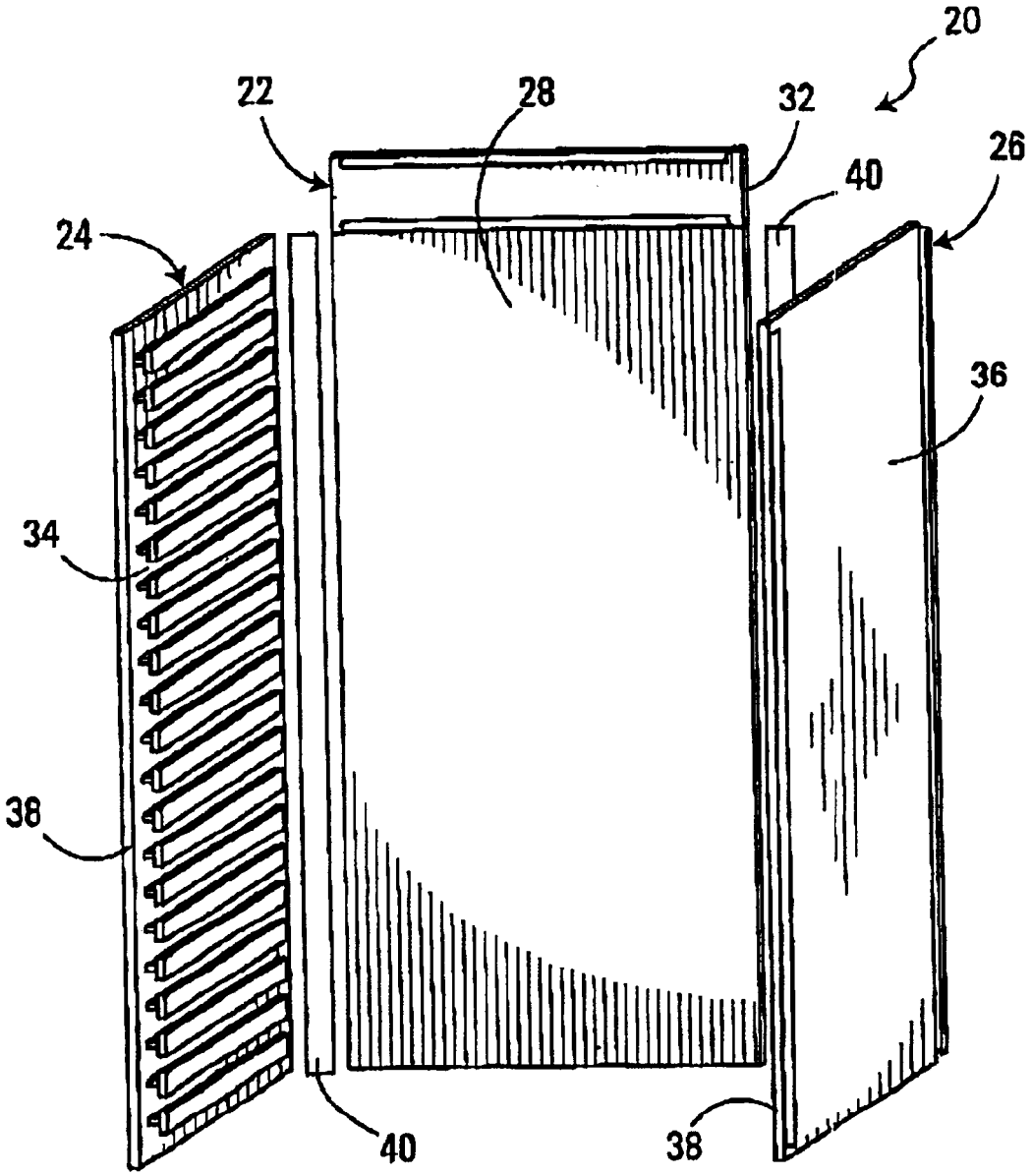
FIG. 1 is an exploded view of the display structure in accordance with a first example of implementation of the present invention.

In the drawings, embodiments of the invention are illustrated by way of example. It is to be expressly understood that the description and drawings are only for the purposes of illustration and as an aid to understanding, and are not intended to be a definition of the limits of the invention.

DETAILED DESCRIPTION

FIG. 1 is an exploded view of a collapsible display structure 20 in accordance with a specific example of implementation of the present invention. As can be seen, collapsible display structure 20 includes a back panel 22, a first wing panel 24 and a second wing panel 26. Back panel 22 includes a front surface 28, a back surface (not shown) and two opposed lateral edge 30 and 32. First wing panel 24 and second wing panel 26 each have an interior surface 34 (shown on first wing panel 24) an exterior surface 36 (shown on second wing panel 26), and a peripheral edge 38 positioned between the interior surface 34 and the exterior surface 36. In the embodiment shown, first wing panel 24 and second wing panel 26 are both rectangular in shape and therefore peripheral edge 38 includes four portions, namely a top portion, a bottom portion, a front portion and a back portion. It should be appreciated that the first wing panel 24 and the second wing panel 26 may be formed into any shape or size that is suitable to be connected to back panel 22.

Positioned between first wing panel 24 and back panel 22, and between second wing panel 26 and back panel 22 are flexible strips 40. Flexible strips 40 are preferably made of flexible synthetic materials, including plastics, which is able to bend repeatedly without breaking. Flexible strips 40 are adapted to connect the first wing panel 24 and the second wing panel 26 to differing ones of the two opposed lateral edges 30 and 32. In a preferred embodiment flexible strips 40 are thermally bonded between the first wing panel 24 and the back panel 22 and between the second wing panel 26 and the back panel 22. It should be appreciated that flexible strips 40, can be attached between the panels using adhesive glue, staples or any other suitable fastening techniques.

Once connected, flexible strips 40 act as hinges to allow first and second wing panels 24 and 26 to move between an expanded position and a collapsed position, which will be discussed in more detail further on in the specification. It should be appreciated that the flexible strips 40 are a preferred embodiment and that the use of any other suitable form of hinge that allows the first and second wing panels 24 and 26 to rotate relative to back panel 22, is within the scope of the invention. Hinges are well known in the art and will not be described further herein.

Figure 2:
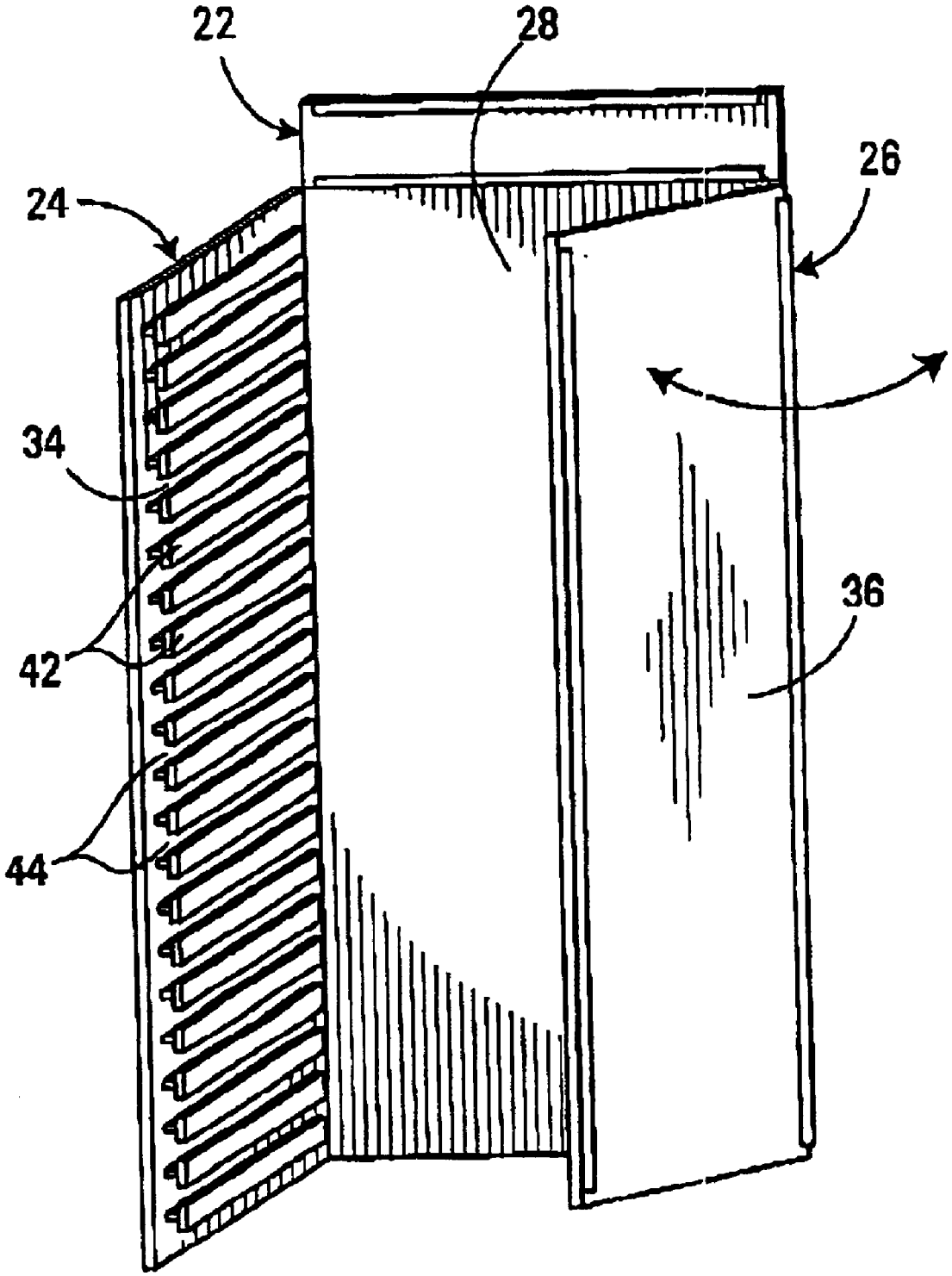
FIG. 2 is a perspective view of the display structure shown in FIG. 1 in an assembled state with one wing panel in a collapsed position.

Shown in FIG. 2 is collapsible display structure 20 with the first wing panel 24 in the expanded position and the second wing panel 26 in the collapsed position. When both first wing panel 24 and second wing panel 26 are in the expanded position, the interior surfaces 34 of the first wing panel 24 and second wing panel 26 face each other. In the preferred embodiment shown in FIG. 4, in the expanded position, first wing panel 24 and second wing panel 26 are positioned substantially perpendicularly to back panel 22. However, it should be expressly understood that first wing panel 24 and second wing panel 26, in the expanded position, may be positioned in other configurations as well. When both first wing panel 24 and second wing panel 26 are in the collapsed position, the first and second wing panels 24 and 26 swing inwardly so that their interior surfaces 34 oppose the front surface 28 of back panel 22. In a variant, it is possible that in the collapsed position, the first and second wing panels 24 and 26 swing backwardly such that their exterior surfaces 36 oppose the back surface (not shown) of back panel 22.

Positioned on the interior surfaces 34 of first wing panel 24 and second wing panel 26 are a series of guides 42. In the preferred embodiment shown in FIGS. 1, 2 and 4, guides 42 are integral to the first and second wing panels 24 and 26, and are formed as T-shaped protrusions, wherein the thin stem of the T extends from the interior surface 34 of the first and second wing panels 24 and 26. Each guide 42 extends along the width of first and second wing panels 24 and 26 but does not extend as far as the peripheral edge 38. As such, in the expanded position, a gap is formed between each guide 42 and the front surface 28 of back panel 22. Between each pair of consecutive guides 42 is a T-shaped groove 44 that is adapted to slidably receive at least a portion of a shelf module. The shelf modules will be discussed in more detail further on.

Figure 4:
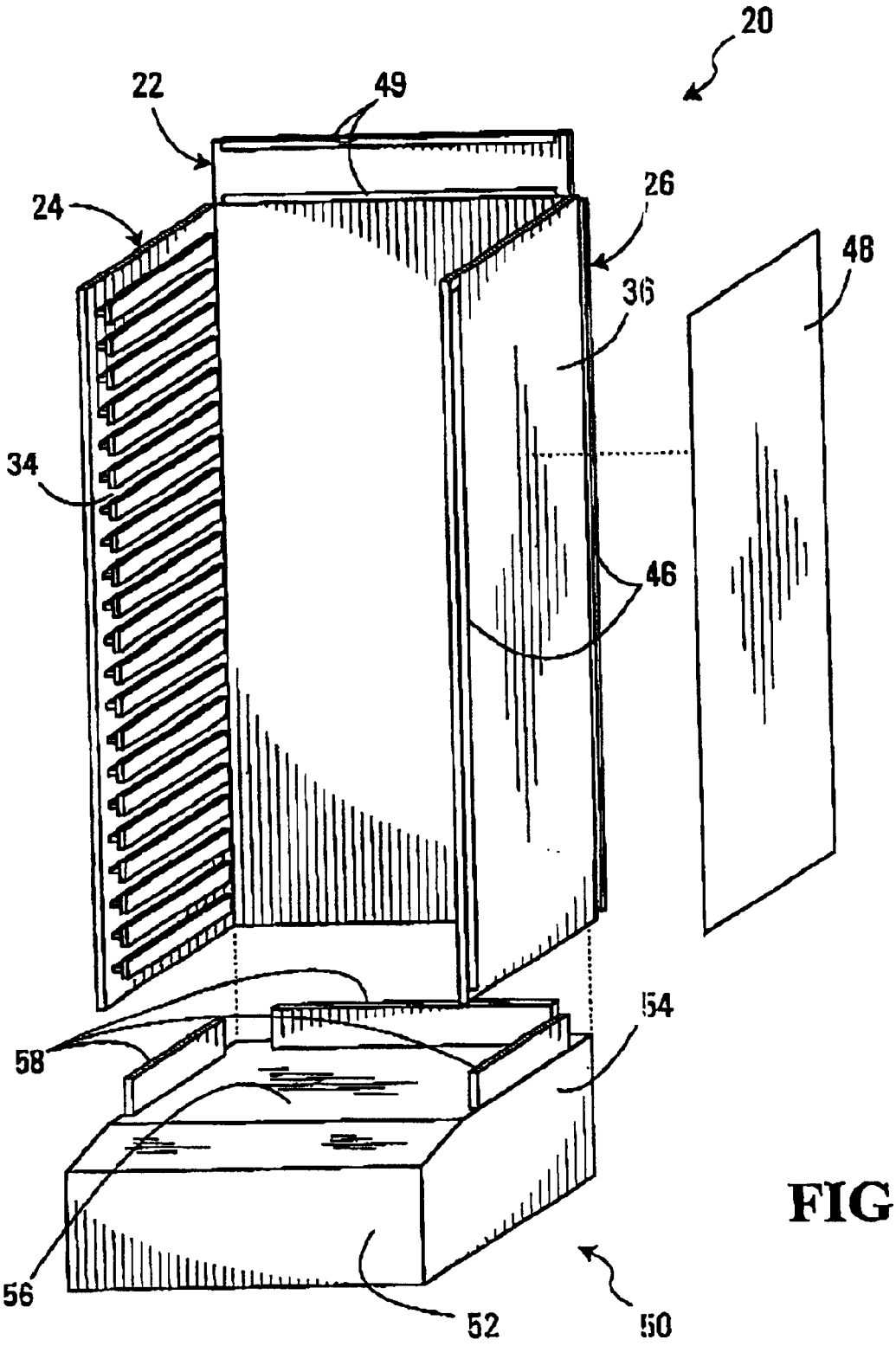
FIG. 4 is a perspective view of tike display structure shown in FIG. 2, a base portion and a graphic presentation element.

In the preferred embodiment shown FIGS. 1, 2 and 4, there is a uniform distance separating each T-shaped protrusion. It should be expressly understood however, that it is within the scope of the invention for guides 42 to be positioned at varying intervals on the interior surface 34 of first and second wing panels 24 and 26.

Figure 3A:
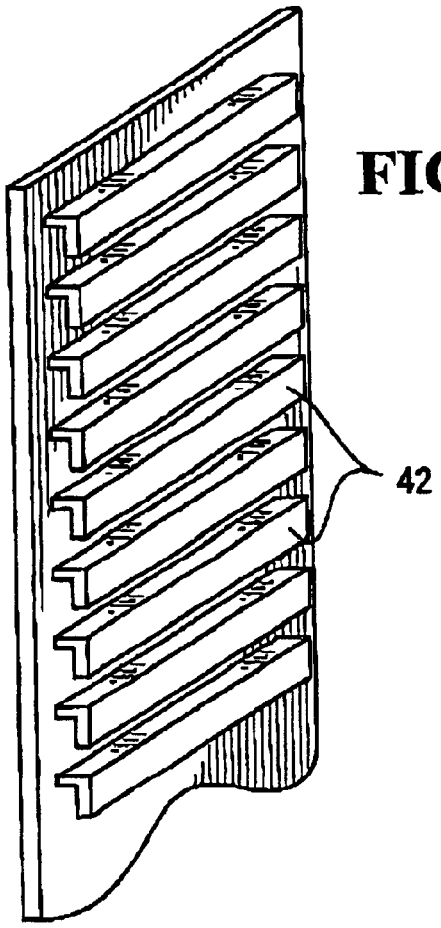
FIGS. 3A-B show alternate embodiments of the guides of the display structure shown in FIG. 2.
Figure 3B:
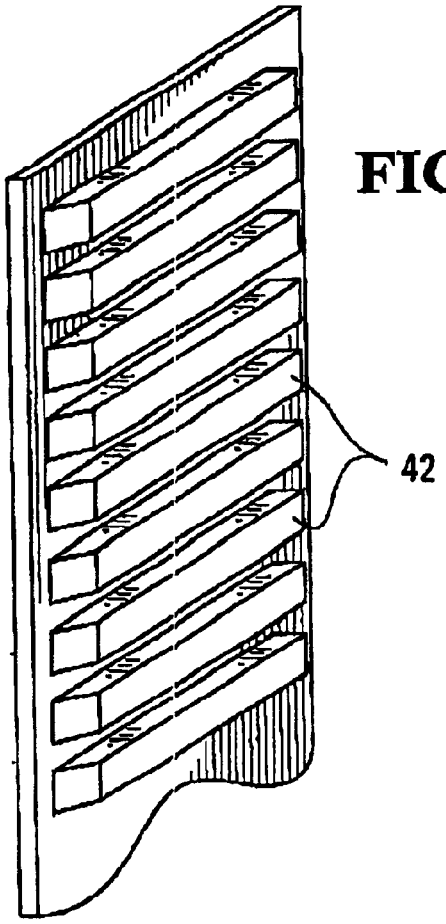

FIGS. 3A and 3B show alternative embodiments for the guides 42. FIG. 3A shows guides 42 formed into a series of L-shaped protrusions and FIG. 3B shows guides 42 formed into a series of straight protrusions. Depending on the configuration of the guides 42 different grooves 44 will be formed between each consecutive pair of guides 42. Although only two alternative embodiment are shown, guides 42 may be formed into any shape that forms grooves suitable for slidably receiving a portion of a shelf module.

Shown in FIG. 4 is collapsible display structure 20 with first wing panel 24 and second wing panel 26 in the expanded position. Positioned on the exterior surface 36 of both first wing panel 24 and second wing panel 26 is a slot defined by two retaining side walls 46 for slidably receiving a graphic presentation item 48. (only shown on the second wing panel 26 in FIG. 4) Graphic presentation item 48 is preferably in the form of a cardboard advertising sign or promotional sign that contains words, drawings, pictures or a combination of all of the above. It is also within the scope of the invention for the graphic presentation panel 48 to include a 3-dimensional component extending out the exterior surface 36 of the first and second wing panels 24 and 26. Although in the preferred embodiment shown, the exterior surfaces 36 of first wing panel 24 and second wing panel 26 include side walls 46 in order to receive graphic presentation element 48, it is within the scope of the invention for exterior surface 36 to receive a graphic presentation element 48 using other techniques known in the art, such as screws, snaps and transparent films amongst others.

In addition, similarly to the exterior surface 36 of first and second wing panels 24 and 26, the upper portion of the front surface 28 of back panel 22 can include side walls 49 or otherwise be adapted for receiving a graphic presentation element. It is within the scope of the present invention for other areas of the collapsible display element 20 to receive graphic presentation elements as well.

Also shown in FIG. 4 is a base portion 50 that includes a front face 52, a back fare (not shown), two side faces 54 and a top face 56. Although base portion 50 shown in FIG. 4 is in the general shape of a square block, it should be expressly understood that a base portion 50 of any shape or size is within the scope of the invention. Positioned on top face 56 of base portion 50 are protrusions 58 for engaging corresponding hollow openings (not shown) located within the base of back panel 22, first wing panel 24 and second wing panel 26. Collapsible display structure 20 can therefore be removable attached to base portion 50. When collapsible display structure 22 is placed on protrusions 58, first wing portion 24 and second wing portion 26 are maintained in the expanded position.

Alternatively, instead of using a base, it is possible for the back surface (not numbered) of back panel 22 to be mounted to a supporting structure. As a non-limiting example of implementation, it is possible for the back surface of back panel 22 to include hooks that are able to mount collapsible display structure 20 to a wall.

Figure 5:
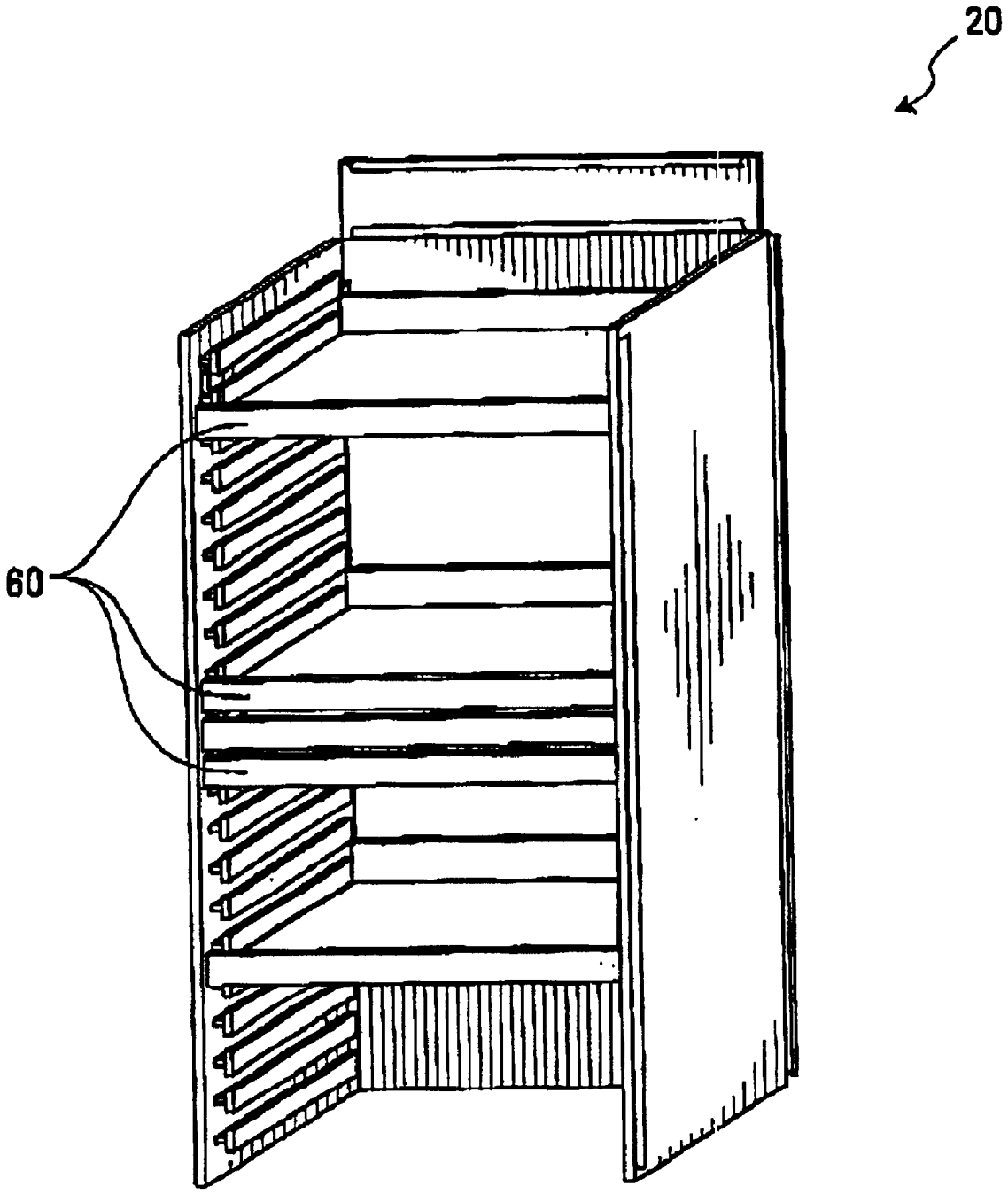
FIG. 5 is a perspective view of the display structure of FIG. 2 with shelf modules Inserted therein.

FIG. 5 shows collapsible display structure 20 with shelf modules 60 according to a first embodiment inserted therein. The shelf modules 60 are suitable for use with display structures that include guides and are able to hold items of merchandise to be displayed. Also, with shelf modules 60 inserted within display structure 20, first wing panel 24 and second wing panel 26 are maintained in the expanded position.

Figure 6:
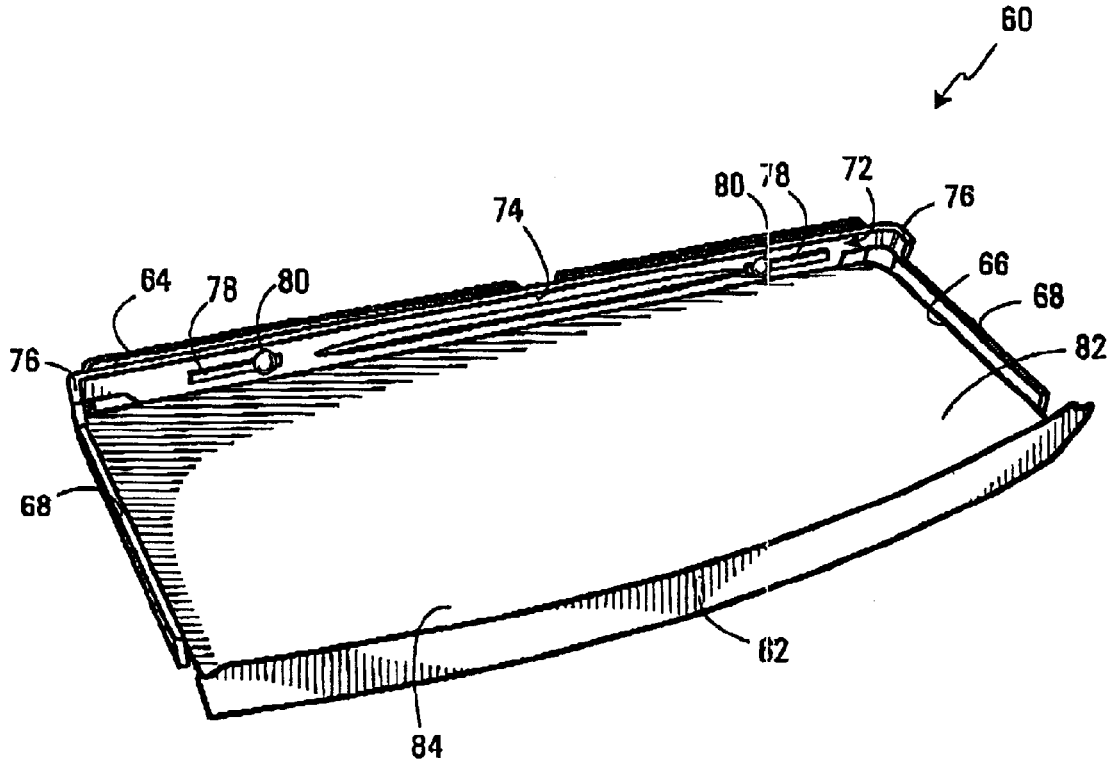
FIG. 6 is a perspective view of a shelf module according to a first embodiment including a locking device shown in the locked position.
Figure 7:
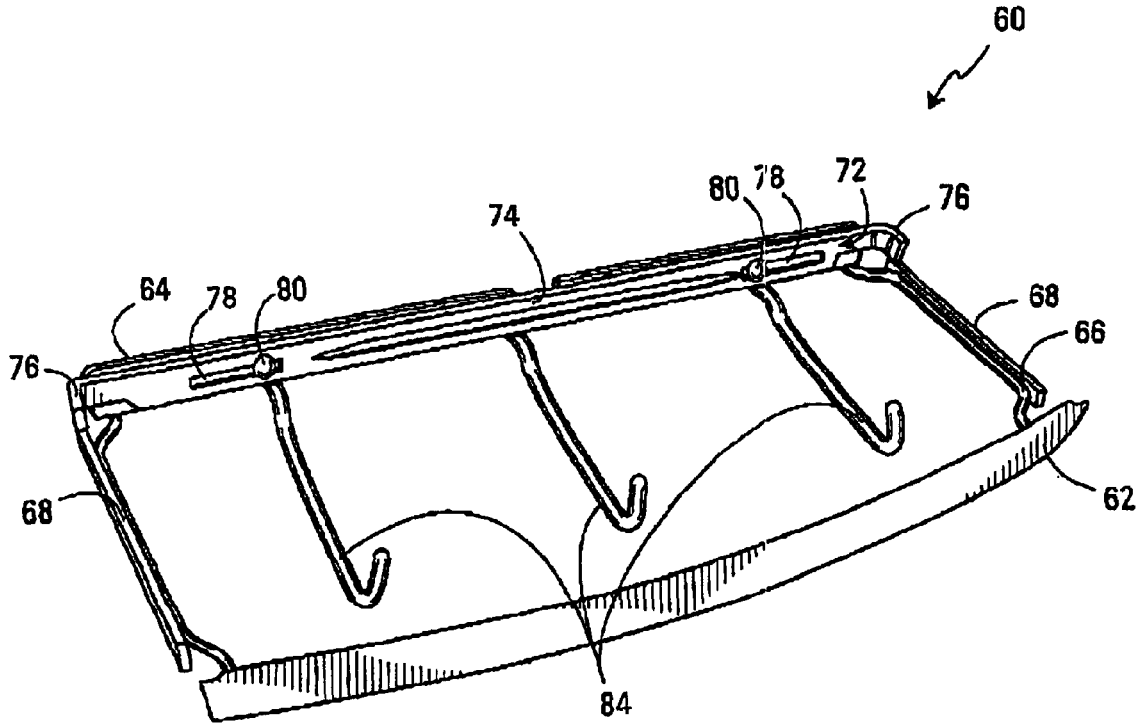
FIG. 7 is a perspective view of a shelf module according to a second embodiment including a locking device shown in the locked position.

FIG. 6 shows shelf module 60 according to a first embodiment, and FIG. 7 shows shelf module 70 according to a second embodiment. As can be seen in FIGS. 6 and 7 both shelf modules 60 and 70 include a frame having a front portion 62, a back portion 64 and two opposed side portions 66. Attached to each side portions 66 are guide-engaging elements 68, which are adapted to engage the guides 42 on the interior surface 34 of first and second side wings 24 and 26 of display structure 20 shown in FIGS. 1, 2 and 4. Specifically, guide-engaging elements 68 are adapted to slide within grooves 44. Guide-engaging elements 68 may be formed into any shape that corresponds to the shape defined by grooves 44.

Both shelf module 60 and shelf module 70 include a merchandise-receiving portion. In shelf module 60 according to the first embodiment shown in FIG. 6, the merchandise-receiving portion includes a platform 82 for holding the merchandise to be displayed. Platform 82 is a part of shelf module 60 and extends between front portion 62 and back portion 64, and between the two opposed side portions 66. In shelf module 70 according to the second embodiment shown in FIG. 7, the merchandise-receiving portion includes a series of hooks 84 for holding merchandise to be displayed. Hooks 84 are attached to back portion 64 and extend towards front portion 62. The series of hooks 84 extend between the two opposed sides 66. Although FIG. 7 shows only 3 hooks, it should be expressly understood that any number or hooks may be positioned between the two opposed side portions 66. In addition, hooks 84 of any suitable shape and size are within the scope of the invention.

In a non-limiting example of implementation, the merchandise-receiving portions are integral or otherwise permanently fixed to shelf modules 60 and 70.

Although only two embodiments of shelf modules having different merchandise-receiving portions are described above, a shelf module including any form of merchandise-receiving portion is within the scope of the present invention. As a non-limiting example, is possible that platform 82 includes a series of protruding walls that define slots for receiving items such as toothbrushes.

Figure 8:
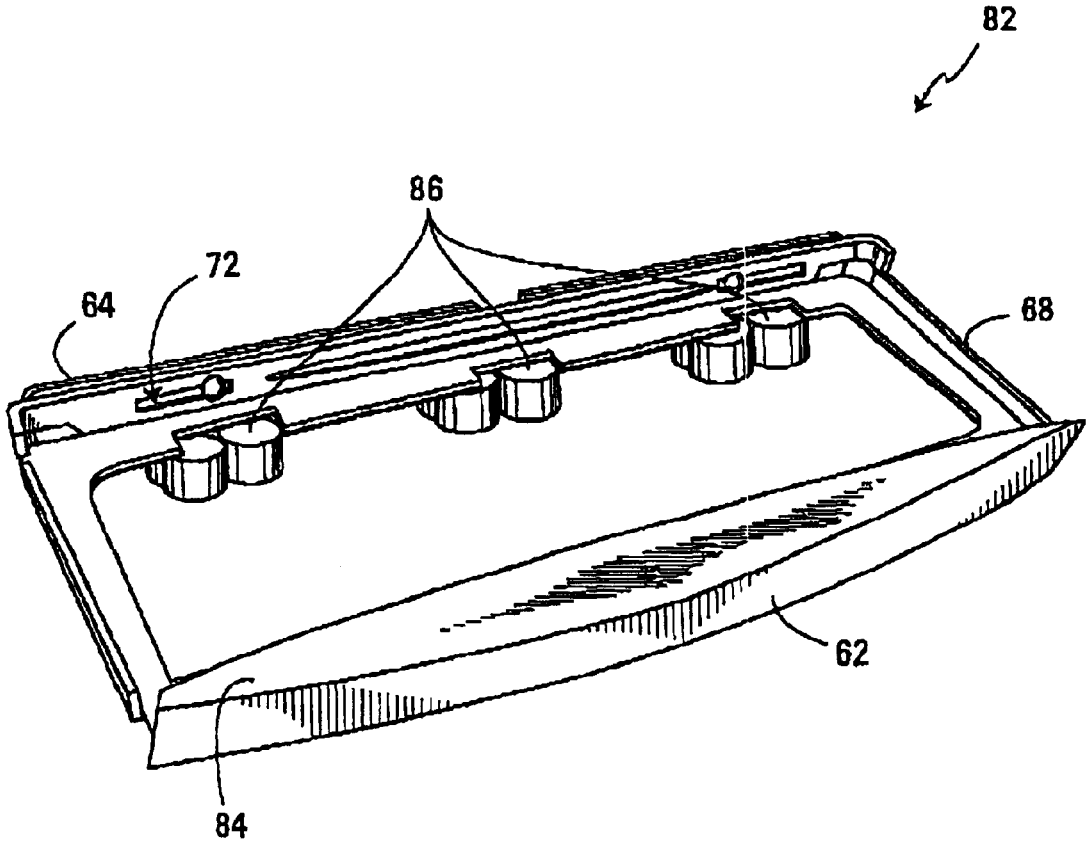
FIG. 8 is a perspective view of a shelf module according to a third embodiment including a locking device shown in the locked position.

FIG. 8 shows a shelf module 82 according to a third embodiment. Similarly to shelf modules 60 and 70, shelf module 82 includes a front portion 62, a back portion 64, two opposed side portions 66 and guide-engaging elements 68. A distinction between shelf modules 60 and 70 and shelf module 82 is that shelf module 82 does not include a merchandise-receiving portion as part of the shelf module. Instead, shelf module 82 includes an inner rim 84 and a plurality of universal connectors 86. Inner rim 84 and universal connectors 86 allow an assortment of different merchandise-receiving portions to be releasably attached to shelf module 82. For example, although not shown in the figures, a suitably shaped platform module could rest on inner rim 84, or alternatively hooks of suitable shape and size may be connected to universal connectors 86. Universal connectors 86 may be any type of connector that is able to connect and hold merchandise-receiving portions having different configurations. Some non-limiting examples of universal connectors 86 may include clamps or bolt connectors as well as hooks have various configurations. Shelf modules 82 have the advantage that they can receive various types of merchandise-receiving portions such as to provide a suitable shelf module for various types of merchandise for display. In this manner, a common type of shelf module is used with different merchandise-receiving portions.

Positioned on the back portion 64 of shelf modules 60, 70 and 82 is a locking device 72. Locking device 72 is preferably made of an elongated strip 74 that includes two terminal ends and is positioned along a longitudinal axis that extends between the two terminal ends. Elongated strip 74 is preferably made of a resilient flexible plastic material. Positioned on the two terminal ends of locking device 72 are blocking elements 76 that extend from back portion 64 towards front portion 62.

Locking device 72 includes two slots 78 that extend along the longitudinal axis of locking device 72. Fixedly attached to back portion 64 of the shelf modules 60 and 70 are two pegs 80 that extend through the two elongated slots 78 of locking device 72. Pegs 80 can be made of plastic materials, metal or any other suitable material. Pegs 80 are adapted to maintain locking device 72 fixed to the back portion 64 of shelf modules 60, 70 and 82 and further allow locking device 72 to move between a locked position and an unlocked position.

In FIGS. 6, 7 and 8 locking device 72 is shown in the locked position. In the locked position, pegs 80 are positioned at an inner position within slots 78, and blocking elements 76 are positioned outwardly at least as far as said guide-engaging elements 68. In the locked position, blocking elements 76 may be positioned directly above or below guide-engaging elements 68, or alternatively may be positioned slightly behind the ends. of guide-engaging elements 68. In addition blocking elements 76 may extend outwardly only as far as guide-engaging elements 68 or may extend outwardly slightly farther than guide-engaging elements 68.

In the locked position, blocking elements 76 are able to prevent shelf modules 60, 70 and 82 from being inserted within grooves 44. Alternatively, if a shelf modules 60, 70 or 82 is already positioned within display structure 20, then in the locked position blocking elements 76 fit between the gap formed between the ends of guides 42 and the front surface 28 of back panel 22 and butt against guides 42 so as to prevent the shelf module 60, 70 or 82 from being removed from display structure 20.

Figure 9:
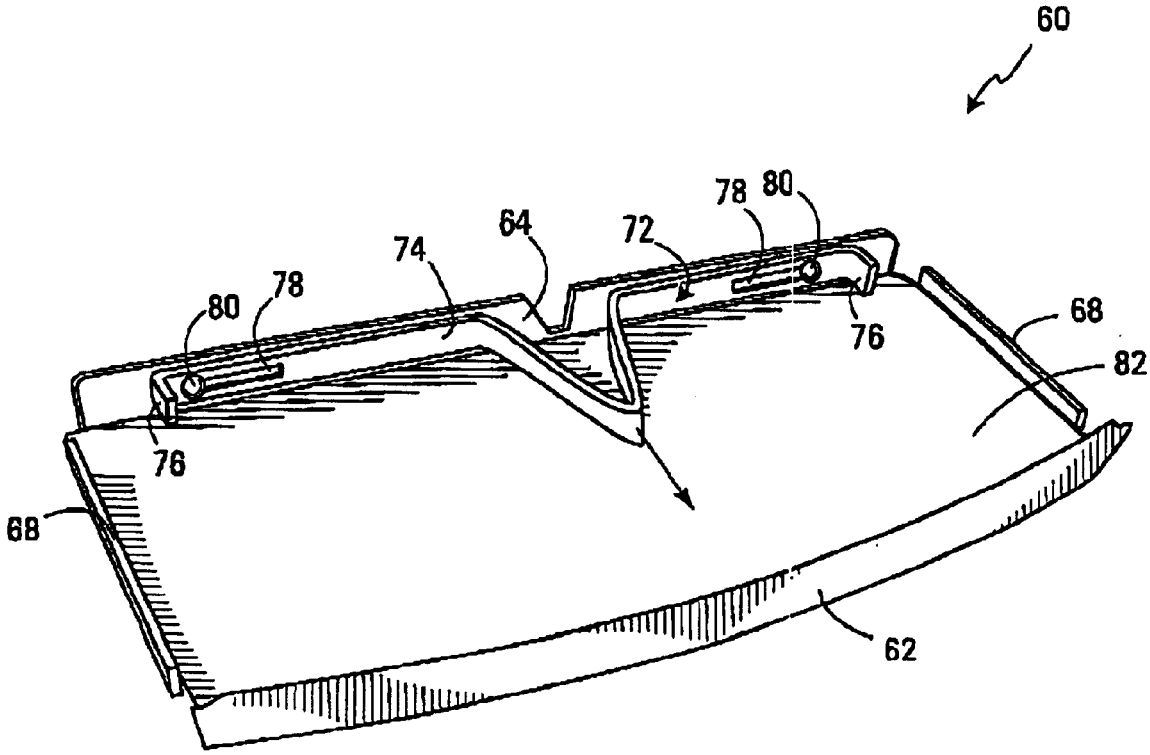
FIG. 9 is a perspective view of the shelf module of FIG. 6 shown with the locking device in the unlocked position.

FIG. 9 shows shelf module 60 according to the first embodiment with locking device 72 in the unlocked position. In this position elongated strip 74 is positioned inwardly so that pegs 80 are positioned at an outer position of slots 78, and blocking elements 76 are located inwardly of the guide-engaging elements 68. In this position, blocking elements 76 do not prevent guide-engaging elements 68 from slidably moving within grooves 44, and therefore shelf modules 60, 70 and 82 may be is inserted or removed from display structure 20.

In a specific example, collapsible display structure 20 and shelf modules 60, 70 and 82 made of a plastic material which have the benefit of being less expensive than metal components. Furthermore, plastic components that are movable in relation to other plastic components cause less wear on the components than metal components that are movable in relation to plastic components.

Although various embodiments have been illustrated, this was for the purpose of describing, but not limiting, the invention. Various modifications will become apparent to those skilled in the art and are within the scope of this invention, which is defined more particularly by the attached claims.

What is claimed is:

1. In combination:

a collapsible display structure comprising:

a) a back panel having a front surface, a back surface, and two opposed lateral edges;

b) a first wing panel and a second wing panel each having:

i) an interior surface including guides for receiving at least a portion of a shelf module;

ii) an exterior surface;

iii) a peripheral edge;

c) said first wing panel and said second wing panel being hingedly connected to said back panel such that said first wing panel and said second wing panel are movable between an expanded position and a collapsible position wherein in the expanded position the interior surface of said first wing panel and the interior surface of said second wing panel face each other and are positioned to receive therebetween a shelf module;

a shelf module comprising:

a) a frame having a front portion, a back portion and two opposed side portions;

b) a merchandise-receiving portion suitable for holding an item of merchandise to be displayed, said merchandise-receiving portion being positioned between said front portion and said back portion and between said two opposed side portions;

c) guide-engaging elements positioned along said two opposed side portion for slidably engaging said guides on said display structure;

d) a locking device positioned along said back portion, said locking device being movable between a locked position and an unlocked position, wherein;

i) in the locked position said locking device prevents said shelf module from being inserted or removed from the display structure;

ii) in the unlocked position said locking device allowing said shelf module to be inserted or removed from said display structure.

2. A combination as disclosed in claim 1, wherein said locking device includes an elongated flexible strip having two terminal ends, said flexible strip being positioned along said back portion and along a longitudinal axis extending between said two terminal ends.

3. A combination as disclosed in claim 2, wherein said elongated strip includes a resilient flexible strip of materials including plastics.

4. A combination as disclosed in claim 3, wherein said elongated strip includes at least two elongated slots positioned along said longitudinal axis.

5. A combination as disclosed in claim 4, wherein pegs fixedly connected to said back portion of said shelf module extend through said elongated slots of said locking device for connecting said locking device to said shelf module.

6. A combination as disclosed in claim 5, wherein said elongated strip includes two blocking elements positioned one at each of said terminal ends for engaging with a portion of said guides of said display structure when said locking device is in the locked position.

7. A collapsible display structure comprising:

a back panel having a front surface, a back surface, and two opposed lateral edges;

a first wing panel and a second wing panel each having:

a) an interior surface including guides for receiving at least a portion of a shelf module;

b) an exterior surface;

c) a peripheral edge;

said first wing panel and said second wing panel being hingedly connected to said back panel via flexible strips, such that said first wing panel and said second wing panel are movable between an expanded position and a collapsible position wherein in the expanded position the interior surface of said first wing panel and the interior surface of said second wing panel face each other and are positioned to receive therebetween a shelf module for engagement with the guides on the interior surfaces of said first wing panel and said second wing panel.

8. A collapsible structure as defined in claim 7, wherein at least a portion of the peripheral edge of said first wing panel is hingedly connected to one of the two opposed lateral edges of said back panel and at least a portion of the peripheral edge of said second wing panel is hingedly connected to the other one of the two opposed lateral edges of said back panel.

9. A collapsible structure as defined in claim 7, wherein in said collapsed position the interior surface of said first wing panel and the interior surface of said second wing panel are opposed to the front surface of said back panel.

10. A collapsible structure as defined in claim 7, wherein in said collapsed position the exterior surface of said first wing is opposed to the back surface of said back panel.

11. A collapsible display structure as defined in claim 7, wherein said back panel, said first wing panel, said second wing panel and said guides are made of a material including plastics.

12. A collapsible display structure as defined in claim 7, wherein said flexible strips are made of a material including plastics, said flexible strips being thermally adhered between said first wing panel and said back panel, and between said second wing panel and said back panel.

13. A collapsible display structure as defined in claim 11, wherein said guides include a series of spaced apart T-shaped protrusions.

14. A collapsible display structure as defined in claim 13, wherein said T-shaped protrusions are uniformly spaced along the interior surface of said first wing panel and said second wing panel.

15. A collapsible display structure as defined in claim 11, wherein said guides include a series of spaced apart L-shaped protrusions.

16. A collapsible display structure as defined in claim 13, wherein two T-shaped protrusions form a groove adapted to slidably receive a shelf unit.

17. A collapsible display structure as defined in claim 11, wherein the exterior surface of said first wing panel is adapted to receive a graphic presentation element.

18. A collapsible display structure as defined in claim 11, wherein said collapsible display structure includes a base portion.

19. A collapsible display structure as defined in claim 18, wherein said back panel, said first wing panel and said second wing panel are removably attachable to said base portion.

20. A collapsible display structure as defined in claim 11, wherein said back panel is adapted to be mounted to a supporting structure.

21. A collapsible display structure comprising:

a back panel having a front surface, a back surface, and two opposed lateral edges;

a first wing panel and a second wing panel each having:

a) an interior surface including guides for receiving at least a portion of a shelf module;

b) an exterior surface;

c) a peripheral edge;

d) said first wing panel and said second wing panel being hingedly connected to said back panel such that said first wing panel and said second wing panel are movable between an expanded position and a collapsible position wherein in the expanded position the interior surface of said first wing panel and the interior surface of said second wing panel face each other and are positioned to receive therebetween a shelf module for engagement with the guides on the interior surfaces of said first wing panel and said second wing panel;

a base portion, wherein said first wing panel, said second wing panel and said back panel are attachable to said base portion.

22. A collapsible structure as defined in claim 21, wherein at least a portion of the peripheral edge of said first wing panel is hingedly connected to one of the two opposed lateral edges of said back panel and at least a portion of the peripheral edge of said second wing panel is hingedly connected to the other one of the two opposed lateral edges of said back panel.

23. A collapsible structure as defined in claim 21, wherein in said collapsed position the interior surface of said first wing panel and the interior surface of said second wing panel are opposed to the front surface of said back panel.

24. A collapsible structure as defined in claim 21, wherein in said collapsed position the exterior surface of said first wing is opposed to the back surface of said back panel.

25. A collapsible display structure as defined in claim 21, wherein said back panel, said first wing panel, said second wing panel and said guides are made of a material including plastics.

26. A collapsible display structure as defined in claim 25, wherein said first wing panel and said second wing panel are hingedly connected to said back panel by flexible strips.

27. A collapsible display structure as defined in claim 26, wherein said flexible strips are made of a material including plastics, said flexible strips being thermally adhered between said first wing panel and said back panel, and between said second wing panel and said back panel.

28. A collapsible display structure as defined in claim 25, wherein said guides include a series of spaced apart T-shaped protrusions.

29. A collapsible display structure as defined in claim 28, wherein said T-shaped protrusions are uniformly spaced along the interior surface of said first wing panel and said second wing panel.

30. A collapsible display structure as defined in claim 25, wherein said guides include a series of spaced apart L-shaped protrusions.

31. A collapsible display structure as defined in claim 28, wherein two T-shaped protrusions form a groove adapted to slidably receive a shelf unit.

32. A collapsible display structure as defined in claim 25, wherein the exterior surface of said first wing panel is adapted to receive a graphic presentation element.

33. A collapsible display structure as defined in claim 21, wherein said first wing panel, said second wing panel and said back panel are removably attachable to said base portion.

34. A collapsible display structure as defined in claim 25, wherein said back panel is adapted to be mounted to a supporting structure.

* * * * *